US011047192B2

(12) United States Patent
Robertson et al.

(10) Patent No.: US 11,047,192 B2
(45) **Date of Patent: *Jun. 29, 2021**

(54) DOWNHOLE POSITIONING AND ANCHORING DEVICE

(71) Applicant: Robertson Intellectual Properties, LLC, Arlington, TX (US)

(72) Inventors: Michael C. Robertson, Mansfield, TX (US); Antony F. Grattan, Mansfield, TX (US); Douglas J. Streibich, Fort Worth, TX (US); Marcelo J. Laxalt, Dallas, TX (US)

(73) Assignee: Robertson Intellectual Properties, LLC, Mansfield, TX (US)

( * ) Notice: Subject to any disclaimer, the term of this patent is extended or adjusted under 35 U.S.C. 154(b) by 218 days.

This patent is subject to a terminal disclaimer.

(21) Appl. No.: 16/459,198

(22) Filed: Jul. 1, 2019

(65) Prior Publication Data

US 2019/0323310 A1 Oct. 24, 2019

Related U.S. Application Data

(63) Continuation of application No. 15/147,755, filed on May 5, 2016, now Pat. No. 10,337,271, which is a continuation-in-part of application No. 14/143,534, filed on Dec. 30, 2013, now Pat. No. 9,416,609, and a continuation-in-part of application No. 13/507,732, filed on Jul. 24, 2012, now Pat. No. 9,863,235.

(60) Provisional application No. 62/157,292, filed on May 5, 2015.

(51) Int. Cl.
*E21B 23/02* (2006.01)
*E21B 29/00* (2006.01)

(52) U.S. Cl.
CPC ..... *E21B 29/00* (2013.01); *E21B 23/02* (2013.01)

(58) Field of Classification Search
CPC ..... E21B 29/00; E21B 23/01; E21B 23/02
See application file for complete search history.

(56) References Cited

U.S. PATENT DOCUMENTS 1,614,840 A 1/1927 Jones
1,677,507 A 7/1928 Vock et al.
2,204,091 A 6/1940 Lowrey
(Continued)

OTHER PUBLICATIONS

International Search Report for Patent Application PCT/US2010/002888, dated Jan. 7, 2011 (25 pages).

*Primary Examiner* — D. Andrews
*Assistant Examiner* — Ronald R Runyan
(74) *Attorney, Agent, or Firm* — Matthews, Lawson, McCutcheon & Joseph, PLLC

(57) ABSTRACT

An anchoring tool for positioning a downhole tool within a wellbore conduit is described herein. The anchor tool uses replaceable blades having protrusions that are configured to align with corresponding grooves in an anchor sub receptacle that is located at a known position along the wellbore conduit. The blades of the anchor tool are configured to move radially relative to the anchor tool body until the anchor tool is aligned with a compatible anchor sub. When the anchor tool and the compatible anchor sub are aligned, the protrusions of the anchor tool blade extend into the grooves of the anchor sub receptacle and a locking mechanism within the anchor tool inhibits further radial movement of the blades. A downhole tool connected to the anchor tool can therefore be positioned at a precise location relative to the known location of an anchor sub receptacle.

15 Claims, 13 Drawing Sheets

(56) References Cited

U.S. PATENT DOCUMENTS

| | | | |
|---|---|---|---|
| 2,350,022 | A | 7/1945 | Burt |
| 2,692,548 | A | 10/1954 | Simmons |
| 2,741,316 | A | 4/1956 | Long |
| 2,862,564 | A | 12/1958 | Bostock |
| 3,019,842 | A | 2/1962 | Nutter |
| 3,175,617 | A | 3/1965 | North |
| 3,344,862 | A | 10/1967 | Conrad |
| 3,355,192 | A | 11/1967 | Kloesel et al. |
| 3,419,079 | A | 12/1968 | Current |
| 3,420,304 | A | 1/1969 | Kilgore |
| 4,108,243 | A | 8/1978 | King et al. |
| 4,369,840 | A | 1/1983 | Szarka et al. |
| 4,466,497 | A | 8/1984 | Soinski et al. |
| 4,510,995 | A | 4/1985 | Krause et al. |
| 4,540,048 | A | 9/1985 | Gazda |
| 4,570,707 | A | 2/1986 | Setterberg, Jr. |
| 4,688,641 | A | 8/1987 | Knieriemen |
| 5,352,308 | A | 10/1994 | Tomihara et al. |
| 5,390,735 | A | 2/1995 | Williamson |
| 5,579,829 | A | 3/1996 | Corneau et al. |
| 5,720,344 | A | 2/1998 | Newman |
| 5,803,176 | A | 9/1998 | Blizzard et al. |
| 5,984,007 | A | 11/1999 | Yuan |
| 6,012,527 | A | 1/2000 | Nitis et al. |
| 6,199,632 | B1 | 3/2001 | Shy |
| 6,209,653 | B1 | 4/2001 | Pringle |
| 6,631,768 | B2 | 10/2003 | Patel et al. |
| 6,761,217 | B1 | 7/2004 | McGarian |
| 6,929,063 | B2 | 8/2005 | Reuse et al. |
| 7,000,704 | B2 | 2/2006 | Smith |
| 7,506,700 | B1 | 3/2009 | Harvey et al. |
| 7,640,975 | B2 | 1/2010 | Cavender et al. |
| 7,726,392 | B1 | 6/2010 | Robertson |
| 7,814,978 | B2 | 10/2010 | Steele et al. |
| 8,616,293 | B2 | 12/2013 | Robertson et al. |
| 2003/0173089 | A1 | 9/2003 | Westgard et al. |
| 2004/0104031 | A1 | 6/2004 | Smith |
| 2005/0072577 | A1 | 4/2005 | Freeman |
| 2007/0246211 | A1 | 10/2007 | Schneider |

DOWNHOLE POSITIONING AND ANCHORING DEVICE

CROSS REFERENCE TO RELATED APPLICATIONS

This application is a continuation application that claims priority to, and the benefit of, U.S. patent application Ser. No. 15/147,755, entitled "Downhole Positioning And Anchoring Device", filed May 5, 2016, which claims priority to Provisional Application No. 62/157,292, entitled "Downhole Positioning And Anchoring Device", filed May 5, 2015, and is a continuation-in-part of U.S. Pat. No. 9,416,609, entitled "Tool Positioning And Latching System, issued on Aug. 16, 2016, and U.S. Pat. No. 9,863,235, entitled "Permanent Or Removable Positioning Apparatus And Method For Downhole Tool Operations", issued on Jan. 1, 2018, all of which are incorporated herein in their entireties by reference.

FIELD OF THE INVENTION

This application relates, generally, to downhole tools and methods of positioning such downhole tools within a wellbore. More particularly, the application relates to apparatus and methods to selectively position and maintain a downhole tool at a location relative to a known downhole reference location.

BACKGROUND

Many wellbore operations require cutting of metallic objects, such as tubing, casing, drill pipe or coiled tubing, in order to release the objects and any associated tools for removal from the wellbore. For example, when conducting drilling operations, it is not uncommon for a drill bit to become stuck. In such a situation, it may be desirable to cut the drill pipe at a location above the drill bit, such that the drill pipe can be retrieved, the drill bit fixed, and drilling operations can be resumed. Cutting efficiency and the necessity of salvaging equipment in close proximity to the drill bit (such as steering equipment, logging equipment, sensors, and other tools) may result in a desire to make the cut at a precise location along the drill string, such as at a joint between two sections of pipe in the drill string or even at a particular thread location in such a joint.

This type of precision may also be necessary for other downhole cutting activities. For example, a cut-to-release packer may provide a window of only a few inches within which a circumferential cut must be made in order to retract the packer's slips and retrieve the packer from the wellbore. Similarly, certain operations may require multiple cuts that must be made at the same location on different trips. Other downhole cutting and non-cutting operations require similar precision in tool placement.

In addition, even when a downhole tool can be placed at a desired location, it is often difficult to maintain the position for the duration of the operation. For example, cutting torches that produce a high pressure jet of gases during operation often create a fluid imbalance that results in the axial movement of the tool and an undesirable cut. To overcome these challenges, it is often necessary to perform a pre-cut operation to allow for fluid balancing between the drill string and the annulus. This requires a separate trip into the wellbore for the pre-cut operation prior to the necessary cutting operation.

While the tools required for these operations can be lowered into the wellbore from the surface using a measurable length of slickline, wireline, coiled tubing, or pipe, there are often difficulties in determining the precise location of the tool due to the elasticity of the lowering material. A small degree of elasticity (which is often an unknown parameter) may result in an unacceptably large error in calculated depth at the depths at which many of these operations take place. Such errors are exacerbated in deviated wells. Accordingly, it is difficult to know the location of a downhole tool with the precision that is required. Existing solutions, such as no-go shoulders, function by intentionally creating an undesirable restriction in the downhole conduit. Moreover, existing solutions do not address the problem of maintaining a downhole tool in the desired location throughout the duration of the operation.

There is therefore a need for methods and apparatus to position a downhole tool with a high degree of precision and to maintain the location of the tool throughout a downhole operation.

SUMMARY

The present invention relates, generally, to apparatus and methods usable for selectively positioning downhole tools within a wellbore and maintaining the downhole tools at a location relative to a known downhole reference location.

Embodiments of the present invention can include a downhole tool, such as an anchor tool, that can be positioned downhole and within a wellbore. The anchor tool can comprise a body, which can be configured to be disposed within a conduit in the wellbore, and one or more blades, which can be configured to move radially relative to the body. In an embodiment, at least one of the one or more blades can comprise a key, which can include a fixed protrusion that can be configured to match a corresponding groove of an anchor sub receptacle positioned within the conduit. The anchor tool can further include a locking mechanism that can comprise a first state and a second state, wherein the first state can permit radial movement of the one or more blades relative to the body of the anchor tool, and the second state can inhibit radial movement of the one or more blades relative to the body of the anchor tool. In an embodiment, the locking mechanism can be configured to switch to the second state from the first state as soon as the fixed protrusion extends into the corresponding groove of the anchor sub receptacle.

In an embodiment, the anchor tool can comprise a first end that can be configured to connect a job-specific tool to the body of the downhole anchor tool. The body of the anchor tool can further include two half cylindrical portions that can be configured to disassemble for replacement of the one or more blades, replacement of a shear pin, or combinations thereof.

In an embodiment of the present invention, the anchor tool can include a spring that can be configured to bias the one or more blades toward an extended radial position relative to the body.

In an embodiment of the anchor tool, the one or more blades can comprise a pivoting protrusion that can be configured to rotate about a connection to each of the one or more blades. The rotation of the pivoting protrusion to a fully retracted position can transition the locking mechanism to the second state.

In an embodiment of the anchor tool, one or more of the paired blades can be positioned opposite each of the one or more blades and can be configured to match with, and lock into, a corresponding paired anchor sub receptacle when the locking mechanism transitions to the second state. The blade can comprise a shear pin receptacle and the locking mechanism can comprise a shear pin that can be configured to align with and extend into the shear pin receptacle, when the locking mechanism is in the second state.

In an embodiment of the anchor tool, the locking mechanism can comprise one or more shear pin housings, and each of the one or more shear pin housings can be configured to contain additional shear pins. In an embodiment, the locking mechanism can be configured to activate only when the anchor tool is traveling in an uphole direction within the conduit.

In an embodiment of the anchor tool, an alignment of the one or more shear pins and the one or more shear pin receptacles can require a correct radial positioning of the one or more blades relative to the body of the anchor tool, and a correct axial positioning of the one or more shear pin housings relative to the one or more blades. An axial positioning of the one or more shear pin housings can be accomplished via a rotation of one or more pivoting members attached to the one or more blades.

The embodiments of the present invention can include methods for selectively positioning a downhole tool. The steps of the method can include: positioning an anchor sub along a conduit in a wellbore, wherein the anchor sub can comprise one or more grooves that define an anchor sub receptacle, and connecting the downhole tool to an anchor tool for selectively positioning the downhole tool in the wellbore. The anchor tool can comprise: a body that can be configured to be disposed within the conduit, and one or more blades that can be configured to move radially relative to the body, wherein at least one of the one or more blades can comprise a key, which can include a fixed protrusion that can be configured to match the one or more grooves of the anchor sub receptacle. The anchor tool can include a locking mechanism that can comprise a first state and a second state, wherein the first state can permit radial movement of the blade relative to the body and the second state can inhibit radial movement of the one or more blades relative to the body. The steps of the method can further include lowering the downhole tool into the tubular string until the anchor tool and the anchor sub receptacle are aligned, and locking the locking mechanism into the second state as soon as the fixed protrusion extends into the one or more grooves of the anchor sub receptacle.

In an embodiment, the method for selectively positioning a downhole tool can include connecting the downhole tool to the anchor tool by connecting a rigid connecting device between the downhole tool and the anchor tool. The length of the rigid connecting device can correspond to a known distance between a location of the anchor sub receptacle and a location of an intended downhole operation using the downhole tool.

In an embodiment of the method for selectively positioning a downhole tool, the downhole tool can be positioned above the anchor tool when the downhole tool is lowered into the tubular string. In an embodiment, the downhole tool can be lowered passed a non-matching anchor sub receptacle before the anchor tool and the anchor sub receptacle are aligned.

In an embodiment, the anchor tool can comprise: a cylindrical body configured to be positioned in a wellbore conduit, a first blade that can extend through a first slot on the body and can include one or more fixed protrusions and a pivoting protrusion, and a second blade that can extend through a second slot on the body and can include one or more fixed protrusions and a pivoting protrusion. The first blade and the second blade can be configured to move radially relative to the body of the anchor tool. The anchor tool can further include a locking mechanism that can be configured to inhibit radial movement of the first blade, the second blade, or combinations thereof, when the one or more fixed protrusions of the first blade and the one or more fixed protrusions of the second blade are engaged in corresponding grooves in the wellbore conduit, and when the pivoting protrusion of the first blade and the pivoting protrusion of the second blade are retracted.

In an embodiment of the anchor tool, the locking mechanism can comprise a shear pin housing that can be configured to move axially with respect to the first blade or the second blade when the pivoting protrusion of the first blade or the pivoting protrusion of the second blade is retracted. In an embodiment, axially moving the shear pin housing with respect to the first blade or the second blade by the pivoting protrusion of the first blade or the pivoting protrusion of the second blade can cause an alignment of the shear pin housing with a corresponding shear pin receptacle disposed in the first blade or the second blade. The locking mechanism can comprise two shear pins, and each shear pin can be disposed in a shear pin housing.

An embodiment of the present invention can include an anchor tool, which can comprise a body configured to be disposed within a conduit in a wellbore, and a blade that can be configured to move radially relative to the body of the anchor tool. The blade can comprise a key, which can have a fixed protrusion that can be configured to match a corresponding groove of an anchor sub receptacle within the conduit in the wellbore. A sliding protrusion can be configured to move radially and axially relative to the body of the anchor tool, and the anchor tool can further include a locking mechanism. The locking mechanism can comprise a first state and a second state, wherein the first state can permit radial movement of the blade relative to the body, and the second state can inhibit radial movement of the blade relative to the body. In an embodiment, the locking mechanism can be configured to switch to the second state from the first state when the fixed protrusion is extended into the corresponding groove and the sliding protrusion are positioned in a first axial position relative to the body.

DESCRIPTION

Before explaining selected embodiments of the present invention in detail, it is to be understood that the present invention is not limited to the particular embodiments described herein, and that the present invention can be practiced or carried out in various ways. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the spirit and scope of the invention.

As well, it should be understood that the drawings are intended to illustrate and plainly disclose presently preferred embodiments to one of skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation. Because many varying and different embodiments may be made within the scope of the concepts herein taught, and because many modifications may be made in the embodiments described herein, it is to be understood that the details herein are to be interpreted as illustrative and non-limiting.

Figure 1:
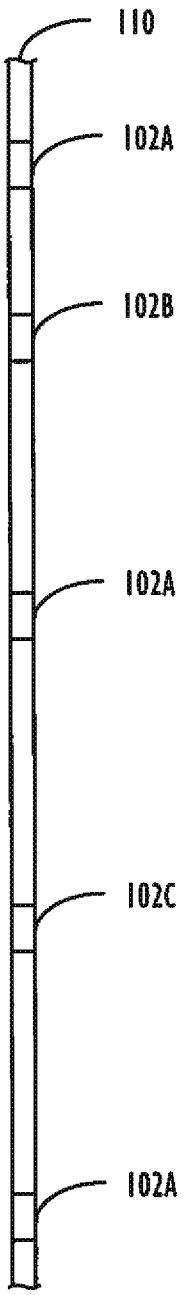
FIG. 1 is a block diagram of anchor subs disposed within a conduit in accordance with an embodiment of the disclosure.

FIG. 1 illustrates a conduit 110 in a potential wellbore operation. The conduit 110 may be a drill string, tubing string, well casing, or other pipe/tube that is lowered or secured within a wellbore. The conduit 110 includes anchor subs 102 that are positioned at various depths within the conduit 110 for anchoring tool operations. As will be illustrated below, anchor subs 102A have different properties from anchor subs 102B which enable them to accept and latch different anchor tools that are lowered into the conduit 110. Likewise, anchor subs 102C have different properties from anchor subs 102A and 102B that enable them to accept and latch further different anchor tools that are lowered into the conduit 110.

Figure 2A:
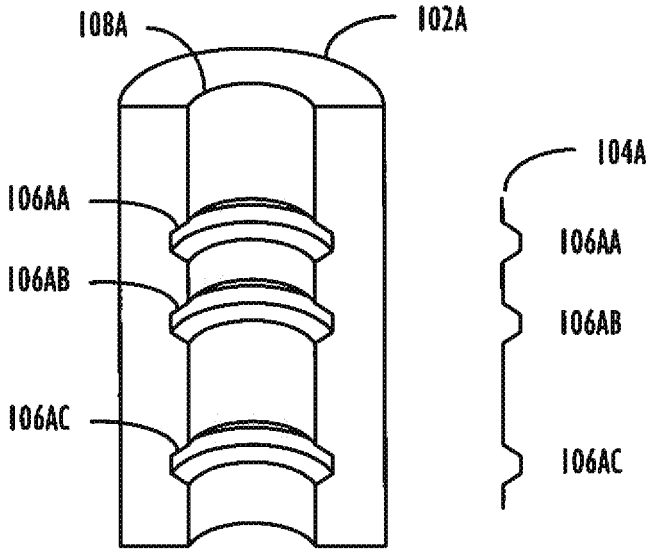
FIG. 2A 2B are cutaway views of anchor subs in accordance with embodiments of the disclosure.
Figure 2B:
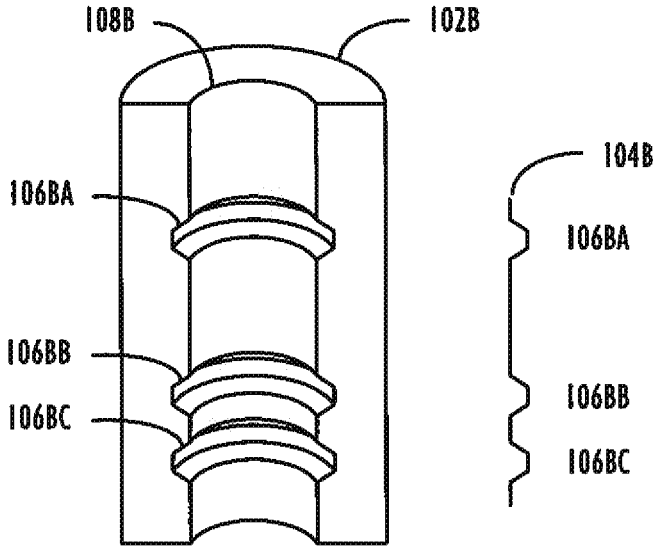

FIGS. 2A and 2B illustrate two example anchor subs 102A and 102B that are may be positioned in one or more known locations along the conduit 110. In certain embodiments, the anchor subs 102A, 102B can include an inner wall (i.e., internal diameter) 108A, 108B, respectively, that matches the internal diameter of the conduit 110 such that the anchor sub 102 does not create a restriction in the conduit. The anchor subs 102A, 102B may include connecting mechanisms (e.g., internal and/or external threads, etc.) for connecting the anchor subs 102A, 102B to neighboring segments in the conduit 110, such that anchor subs 102A, 102B become part of the conduit 110. In practice, anchor subs 102A, 1028 can be disposed along the conduit 110 at locations proximate to likely future location-critical operations as the conduit 110 is inserted into the wellbore. For example, anchor subs 102A, 102B can be positioned proximate to a drill bit in a drilling operation or proximate to a cut-to-release packer, each of which are likely locations of a future location-critical downhole operation. As will be shown below, because the distance between the anchor sub 102 and the location of the potential future location-critical downhole operation is known, a downhole tool can be positioned at the precise location for the operation using the anchor sub 102. Each of the anchor subs 102A, 102B may include one or more circumferential grooves 106 (shown in FIG. 2A as 106AA, 106AB, 106AC and FIG. 28 as 106BA, 106BB, 106BC). The shape and spacing of the grooves 106 along the anchor sub 102 creates an anchor sub receptacle 104 (i.e., anchor sub receptacle 104A for anchor sub 102A; anchor sub receptacle 104B for anchor sub 102B). An anchor tool that is lowered into the conduit 110, having a key that matches an anchor sub receptacle 104, can be held in position in the anchor sub 102. For example, the anchor sub 102A shows three grooves 106AA, 106AB, and 106AC located at three positions, respectively. A corresponding key would have features that match to these three positions. The anchor sub 102B of FIG. 2B shows three grooves 106BA, 106BB, and 106BC that are located at three different positions, respectively, to match a key that is different from the key matching anchor sub 102A.

Figure 3A:
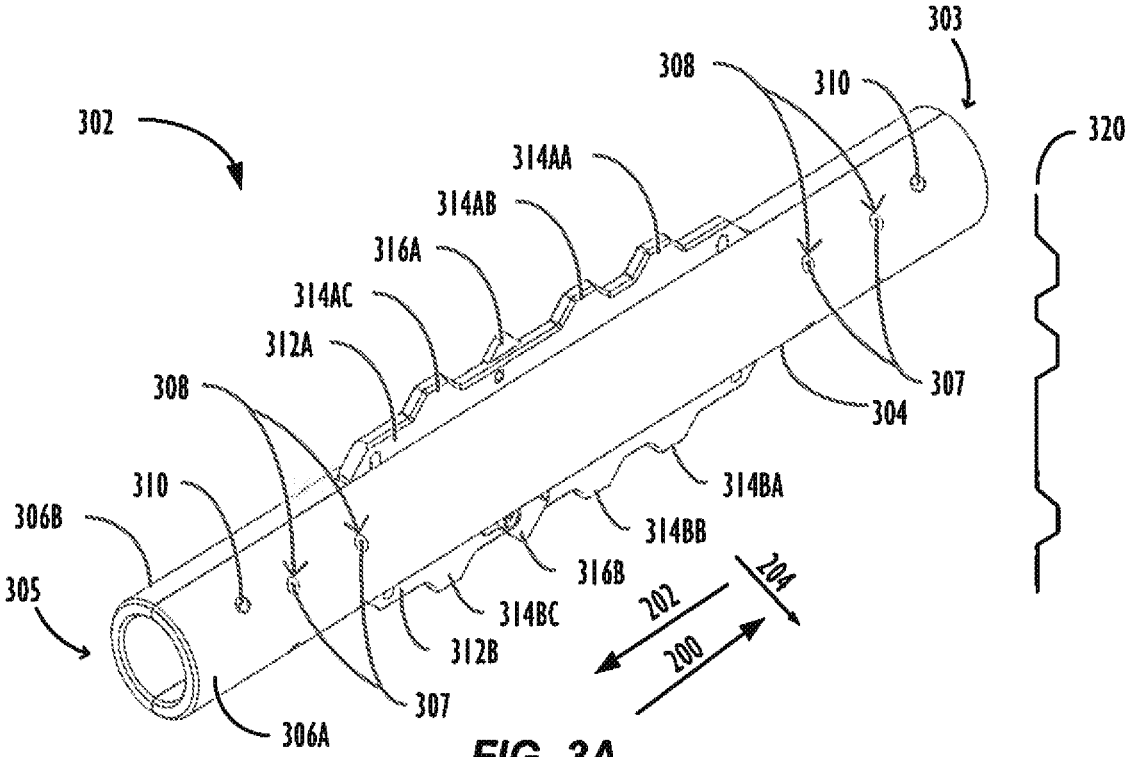
FIGS. 3A and 3B are an isometric view and a side view, respectively, of an anchor tool in a fully extended position in accordance with an embodiment of the disclosure.
Figure 3B:
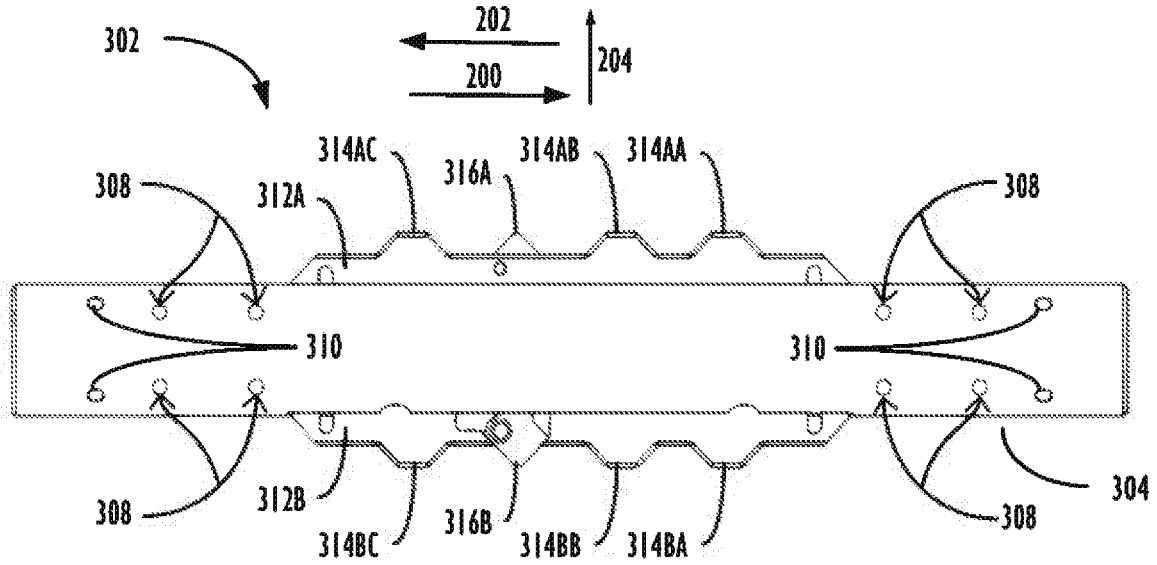

FIGS. 3A and 3B illustrate an isometric view and a side view, respectively, of an anchor tool 302 in a fully extended position. As shown, the anchor tool 302 comprises a main cylindrical portion (i.e., body) 304 that is composed of two half cylindrical portions 306A, 306B joined together by fastening mechanisms 307 (e.g., bolts, screw, pins, etc.), which are situated in internal connection cavities 308. In an embodiment, the anchor tool 302 can be connected to a lowering device (e.g., wireline, slickline, coiled tubing, etc.) at a first end 303 of the cylindrical body and to the job-specific tool (e.g., a cutting torch) at a second end 305 of the cylindrical body by fastening mechanisms 307 that are situated in external connection cavities 310. In another embodiment, the job-specific tool may not be directly coupled to the anchor tool 302. For example, it may be desirable to connect the job-specific tool to the anchor tool 302 by means of a rigid connecting device to provide an offset between the anchor tool 302 and the job-specific tool. In such an instance, the connecting device may be disposed between the job-specific tool and the anchor tool 302 with the connecting device positioned either uphole 200 or downhole 202 of the anchor tool 302.

As shown, a pair of blades 312A, 312B can extend radially outward 204 from the anchor tool through a slot in the cylindrical body. Throughout this specification, the term "radial" 204 is used to describe motion towards and away from the axial centerline of the cylindrical body of the anchor tool. While the described embodiments of the anchor tool include a cylindrical body, other embodiments may employ non-cylindrical bodies. Regardless of the shape of the body, the term radial 204 is used to refer to motion towards and away from the centerline along the length of the body. Similarly, the term "axial" is used to describe motion in a direction along the length of the tool body, regardless of shape.

In the position illustrated in FIGS. 3A and 3B, the blades 312A, 3128 are fully extended (i.e., protruding radially outward 204 from the body of the anchor tool to the maximum extent). As will be described in greater detail below, one or more biasing devices (e.g., springs) can force the blades 312A, 312B toward this extended position. When the anchor tool is inserted into the conduit 110, however, the biasing devices are contracted because the blades track the inner wall of the conduit 110. As such, the position illustrated in FIGS. 3A and 3B represents a shelf state position that is not realized while the anchor tool 302 is traversing through the conduit 110.

The blades 312A, 312B can have one or more fixed protrusions 314 that form an anchor tool key 320. In addition, pivoting protrusions 316A, 316B are affixed to the blades 312A, 312B, respectively, and extend outward from the body of the anchor tool 302 with the blades 312A, 312B. The pivoting protrusions 316A, 316B can additionally pivot in a plane parallel to the plane of the blades 312A, 312B and about a connection point between the pivoting protrusions and the blades 312A, 312B. As will be described in greater detail below, the pivoting protrusions 316A, 316B do not contribute to the profile of the anchor tool key 320 formed by the fixed protrusions 314 (See fixed protrusions 314AA, 314AB, 314AC and 314BA, 314BB, 314BC shown in FIGS. 3A and 3B), but instead serve to lock the blades 312A, 312B into a fixed position relative to the body 304 of the anchor tool 302 when the blades 312A, 312B are aligned with an anchor sub 102A, 102B having an anchor sub receptacle 104A, 104B, respectively, that matches the blades' key 320. For example, because the fixed protrusions 314AA, 314AB, 314AC of the key 320 match the grooves 106AA, 106AB, and 106AC of the anchor sub receptacle 104A of anchor sub 102A, the anchor tool 302 would be locked into place when aligned with anchor sub 102A. Conversely, because the key 320 does not match the anchor sub receptacle 104B, the anchor tool 302 would pass through anchor sub 102B without being latched into place.

Figure 4A:
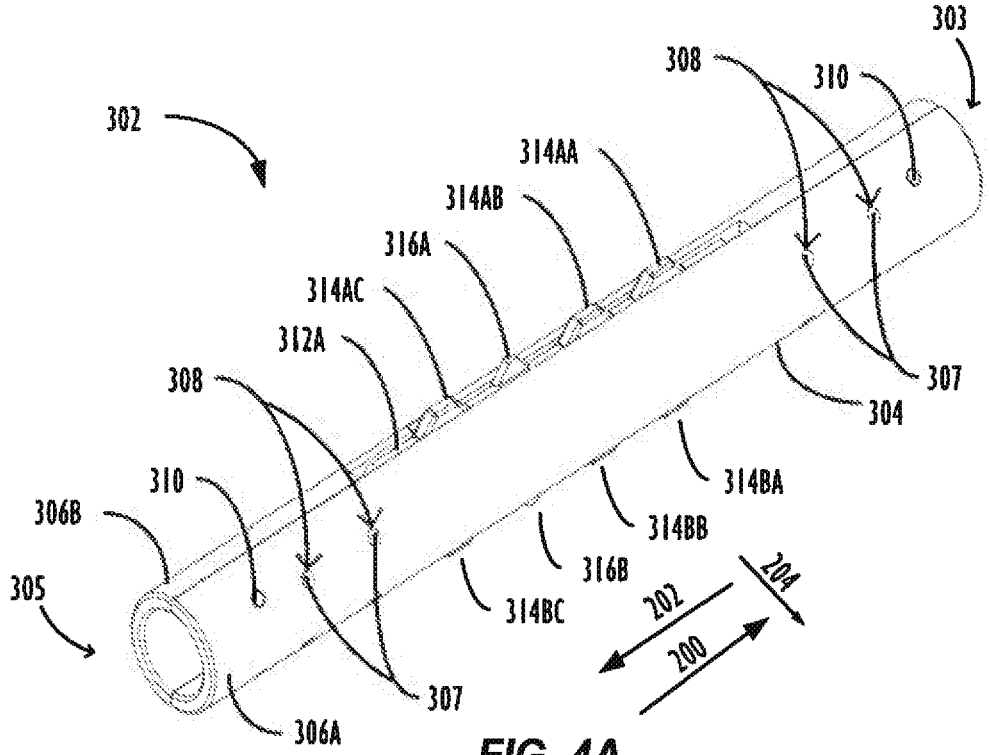
FIGS. 4A and 4B are an isometric view and a side view, respectively, of an anchor tool in a fully retracted position in accordance with an embodiment of the disclosure.
Figure 4B:
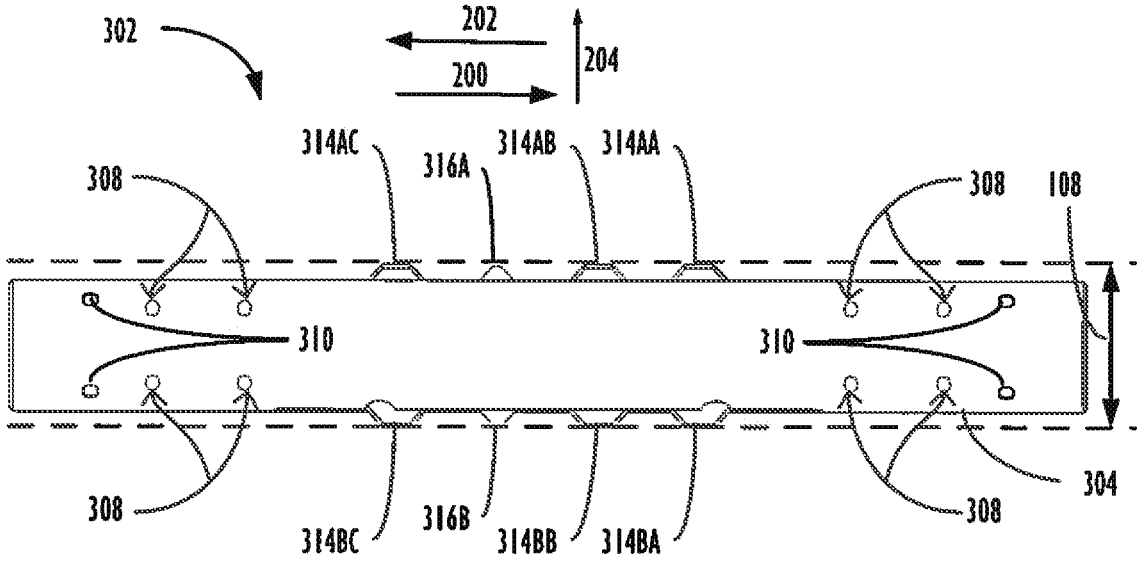

Referring to FIGS. 4A and 4B, the anchor tool 302 is illustrated with blades 312A, 312B in a retracted position. In the retracted position, the anchor tool 302 is arranged and ready to traverse the conduit 110 from the top of the wellbore. During traversal, the outside edges of protrusions 314AA, 314AB, 314AC, 314BA, 314BB, 314BC and 316A, 316B are in contact with the inner wall 108 (Shown in FIG. 4B) of the conduit 110. In this position, the blades 312A, 312B are not fixed relative to the anchor tool body. Rather, the biasing device is actively forcing the blades 312A, 312B outward 204 from the anchor tool body, such that the blades might extend into the grooves 106 of an anchor sub 102A, 102B having an anchor sub receptacle 104A, 104B, respectively, that matches the profile 320 formed by the protrusions 314AA, 314AB, 314AC, 314BA, 314BB, 314BC when the anchor tool 302 and the anchor sub 102A, 102B are properly aligned.

Figure 5A:
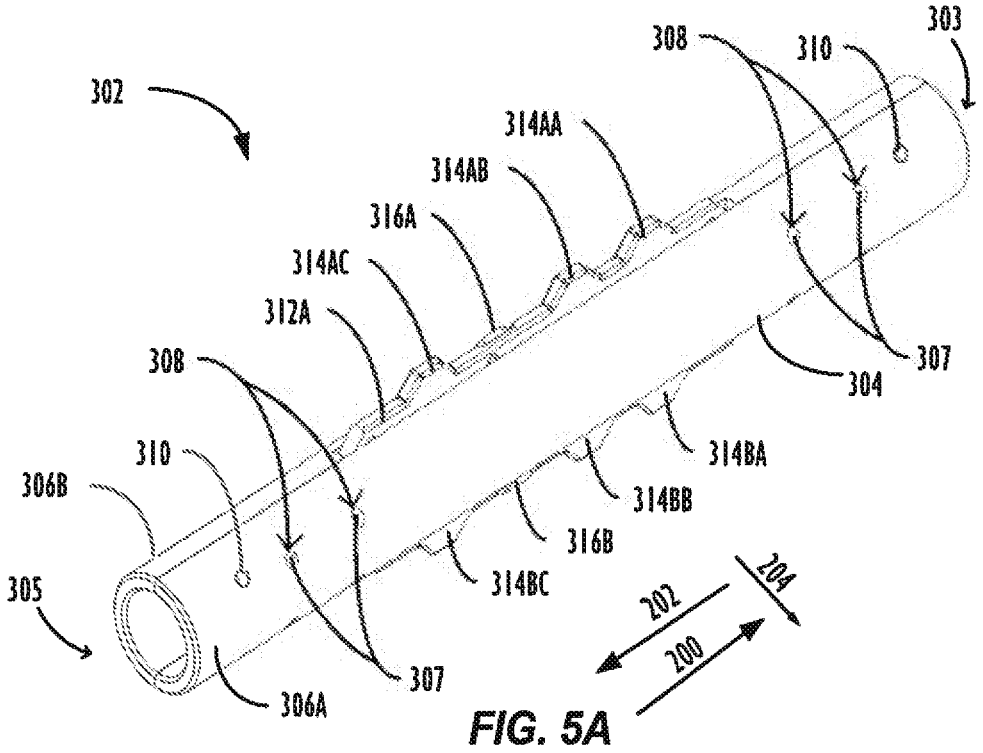
FIGS. 5A and 5B are an isometric view and a side view, respectively, of an anchor tool in a locked position in accordance with an embodiment of the disclosure.
Figure 5B:
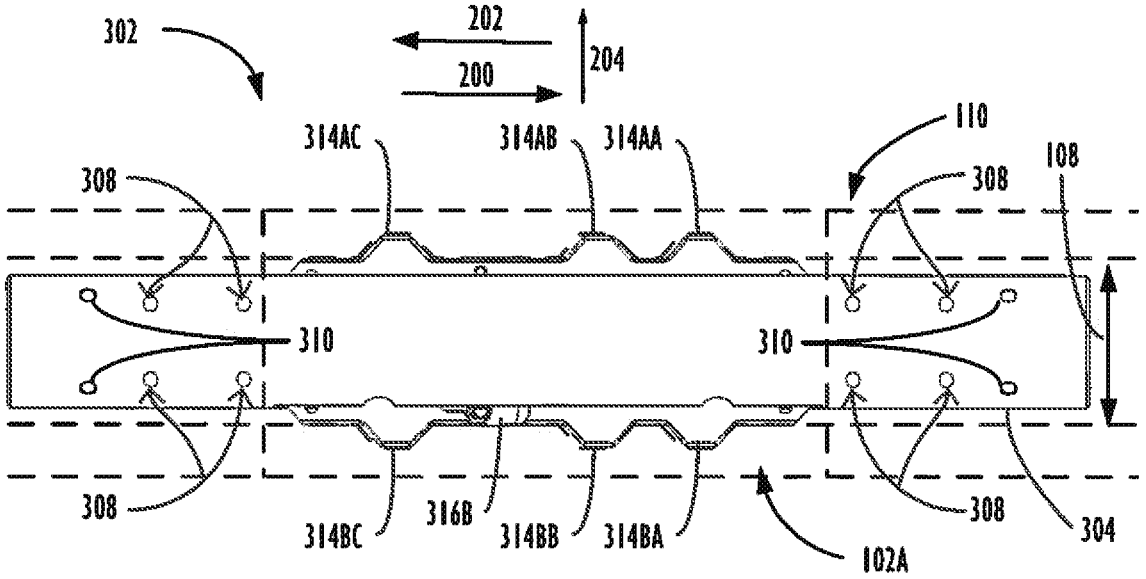

Referring to FIGS. 5A and 5B, the anchor tool 302 is illustrated with blades 312A, 312B locked in a fixed radial position relative to the body of anchor tool 302 (e.g., between the extended and retracted positions illustrated in FIG. 3 and FIG. 4, respectively). When the protrusions 314 are aligned with corresponding grooves 106 of a compatible anchor sub 102 (i.e., an anchor sub having a receptacle 104A that matches the key 320, such as in the case of the illustrated anchor sub 102A) the blades 312 will extend outward. The receptacle 104, however, does not have a groove 106 for the pivoting protrusion 316. Instead of fitting into a groove 106A, 106B, the pivoting protrusions 316A, 316B pivot towards the body of the anchor tool 302, such that a flat portion of the pivoting protrusions 316A, 316B rests against the inner wall of the conduit 110. As will be described in greater detail below, this pivoting action results in the blades 312A, 312B being locked in a fixed radial position relative to the body of the anchor tool 302. Because the blades 312A, 312B are locked with the fixed protrusions 314 engaged in the grooves 106 of the anchor sub 102, the anchor tool 302 is fixed at a known location (i.e., the known location of the anchor sub). This enables a downhole operation to be performed at a precise location within the conduit 110. That is, because an anchor sub 102, having a known receptacle 104, is located in a conduit at a location that is a known distance from a likely operation point (e.g., a likely cutting point), when the anchor tool 302, having a key 320 that corresponds to the receptacle 104, is lowered into the wellbore, it can be guaranteed that a job-specific tool, which is offset from the anchor tool 302 by the known distance, is at the precise desired depth. It should be noted that the described embodiment of the anchor tool 302 will be locked into place in the first anchor sub having a corresponding receptacle (i.e., the anchor sub having a corresponding receptacle that is closest to the surface). Other embodiments allow an anchor tool to pass through a corresponding anchor sub in one direction and to be locked into the corresponding anchor sub when traveling in a different direction. For example, another embodiment allows an anchor tool 302 to pass through a compatible anchor sub 102 when traveling in the downhole direction 202 and to be locked into the first compatible anchor sub 102 that it contacts when traveling in the uphole direction 200.

Figure 6:
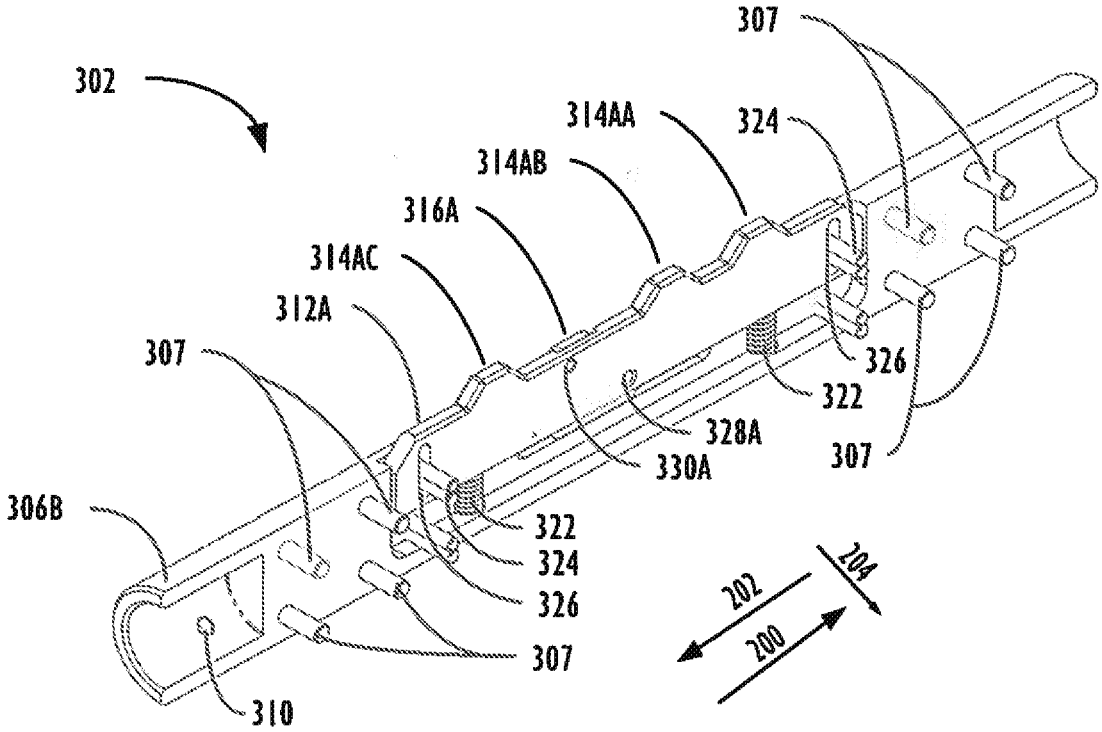
FIG. 6 is a cutaway isometric view showing the internals of an anchor tool in accordance with an embodiment of the disclosure.

Referring to FIG. 6, the half cylindrical body 306A of the anchor tool 302 and the blade 312B have been removed to reveal the internal components of the anchor tool 302. It will be recognized that blade 312B functions as a mirror image of blade 312A. Accordingly, the description of the functionality with respect to blade 312A applies equally to blade 312B. The blade 312A is biased outward 204 from the body of the anchor tool 302 by springs 322. The axial position of the blade 312A with respect to the anchor tool body is maintained by pins 324 that extend through grooves 326 in the blade 312A. The engagement of the pins 324 within the grooves 326 enables the blade 312A to move radially with respect to the body of the anchor tool 302 while inhibiting axial movement of the blade 312A with respect to the anchor tool body. The pivoting protrusion 316A moves radially with the blade 312A and additionally pivots in a plane parallel to the plane of the blade 312A about a pivot connection 330A to the blade 312A. A shear pin receptacle 328A receives a shear pin when the blade 312A is aligned with a compatible anchor sub 102.

Figure 7A:
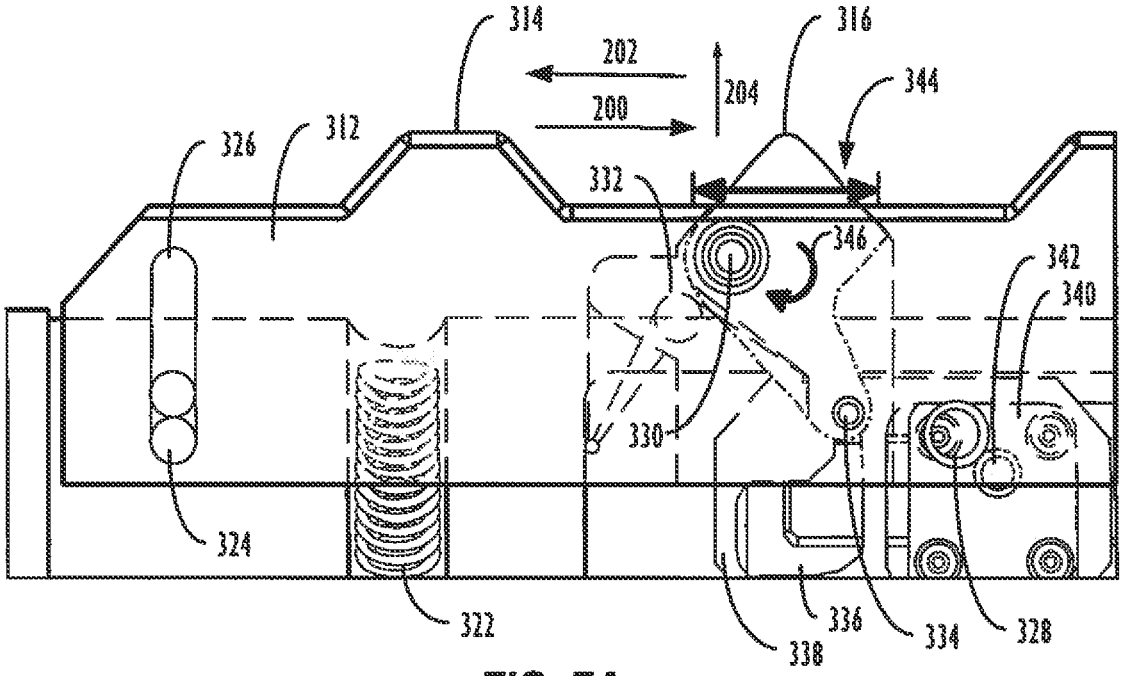
FIGS. 7A and 7B are side views showing the locking mechanisms of an anchor tool in the fully extended and locked positions, respectively, in accordance with an embodiment of the disclosure.

FIG. 7A illustrates an embodiment of the internal components of the anchor tool 302 with the blade 312 illustrated as partially transparent in order to allow a view of the blade locking mechanisms. Blade 312 is illustrated in the fully extended position (i.e., position shown in FIGS. 3A and 3B). In this position, the shear pin receptacle 328 is misaligned with the shear pin 342 in both the radial direction 204 and the axial direction (i.e., downhole 202). Accordingly, the shear pin 342 must move in the radial direction 204 and the downhole axial direction 202 to line up with the shear pin receptacle 328 to lock the blade 312 into the fixed position with respect to the anchor tool 302 body 304. As described above, the springs 322 can exert a radially 204 outward force on the blade 312, causing radial 204 movement of the blade 312 and the shear pin receptacle 328. In certain embodiments, when the blade 312 is fully extended, the shear pin receptacle 328 is radially 204 passed the shear pin 342. However, when each of the blade's protrusions 314 are engaged in a corresponding groove 106 of an anchor sub 102, the blade 312 is in a radial position between the fully extended and retracted positions, and the shear pin receptacle 328 and the shear pin 342 will be radially aligned.

The shear pin receptacle 328 and the shear pin 342 must be axially aligned, however, for the shear pin 342 to lock inside the shear pin receptacle 328. This axial alignment requirement prevents an accidental locking of the blade 312 relative to the anchor tool body when the anchor tool 302 is not fully engaged in a compatible anchor sub 102. If the shear pin 342 and shear pin receptacle 328 were perpetually aligned in the axial direction and latching relied solely upon the radial action of the blade 312, any radial movement of the blade 312 from an irregularity in the inner wall of the conduit 110 or the extension of one or more protrusions 314 into the grooves 106 of a non-compatible anchor sub may result in an unintended locking of the blade 312.

Locking the blade 312 from radial movement relative to the anchor tool body therefore requires not only that the protrusions 314 be fully extended into the grooves 106 of a compatible anchor sub 102 but also that the outer edge of the blade 312, in a region 344 proximate to the pivoting protrusion 316 be in contact with the inner wall of the conduit 110. When all of the fixed protrusions 314 of the blade 312 extend into grooves 106 of a compatible anchor sub 102, and the pivoting protrusion 316 contacts the inner wall of the conduit 110, the pivoting protrusion 316 rotates in the direction of the arrow 346 about pivot connection 330, overcoming the force of a spring 332, which opposes this rotation and biases the pivoting protrusion 316 towards its protruded position. As the pivoting protrusion 316 rotates about the pivot connection 330, a pin 334, which is coupled to the pivoting protrusion 316 and engaged in a carriage track 336 of a carriage 338, moves both radially and axially relative to the body 304 of the anchor tool 302. The movement of the pin 334 within the carriage track 336 of the carriage 338 results in the axial movement of the carriage 338 within the body 304 of the anchor tool 302. The axial movement of the carriage 338 results in axial movement of the shear pin 342, which is disposed within a shear pin housing 340, that is coupled to, and moves axially with, the carriage 338.

Figure 7B:
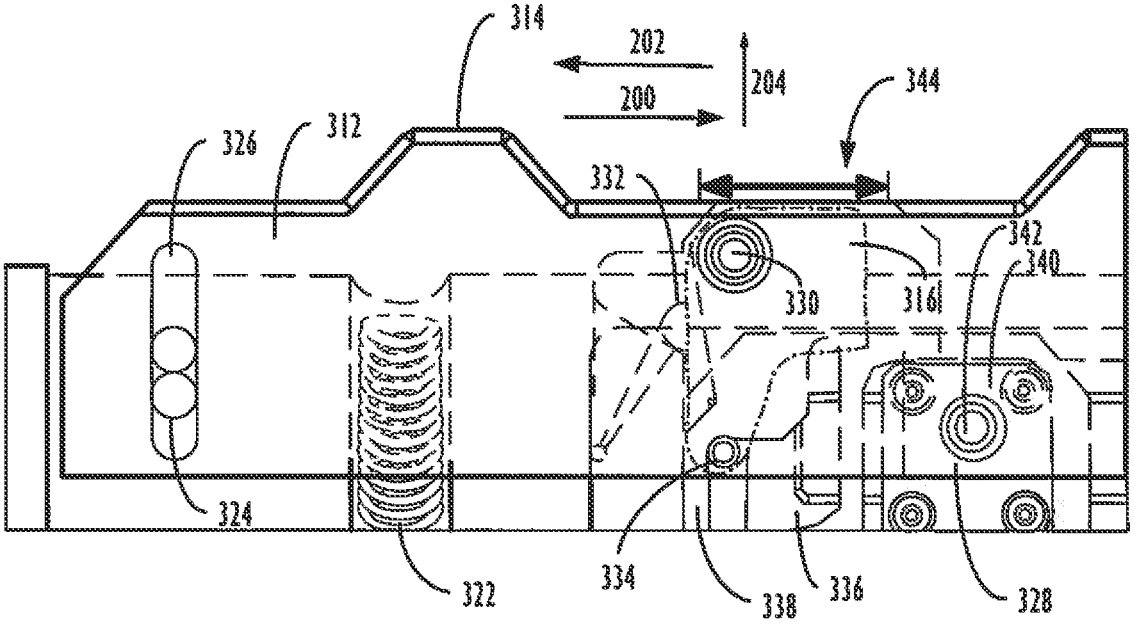

When the pivoting protrusion 316 is in the fully retracted position, as illustrated in FIG. 7B, the axial position of the carriage 338 results in the axial alignment of the shear pin 342 and the shear pin receptacle 328. As will be described below, the shear pin 342 can be disposed within a shear pin housing 340 that can contain a bias device (e.g., a spring) that exerts a force on the shear pin 342 in the direction of the blade 312. When the shear pin 342 is aligned with the shear pin receptacle 328, the shear pin 342 extends into the shear pin receptacle 328. Because the shear pin 342 is fixed radially relative to the anchor tool body, the extension of the shear pin 342 into the shear pin receptacle 328 prevents the radial movement of the blade 312 relative to the anchor tool body 304. Moreover, the engagement of the blade's protrusions 314 with the grooves 106 of the compatible anchor sub 102 prevents axial movement of the anchor tool 302 relative to the conduit 110. Once locked into a compatible anchor sub 102, the anchor tool 302 can only be released by applying a force that is great enough to shear the shear pin 342 in order to re-establish the radial movement of the blade 312. Typically, this force will only be applied by exerting a relatively high amount of tension on the lowering device. Accordingly, when the anchor tool 302 is locked within the anchor sub 102, the job-specific tool is both positioned at a precise location and maintained at that location for the duration of the job.

Figure 8A:
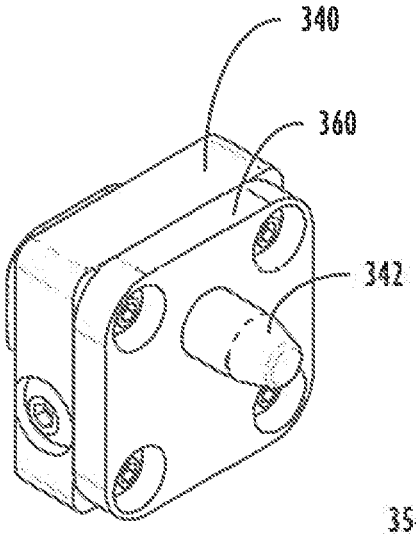
FIG. 8A is an isometric view of a shear pin housing of an anchor tool in accordance with an embodiment of the disclosure.
Figure 8B:
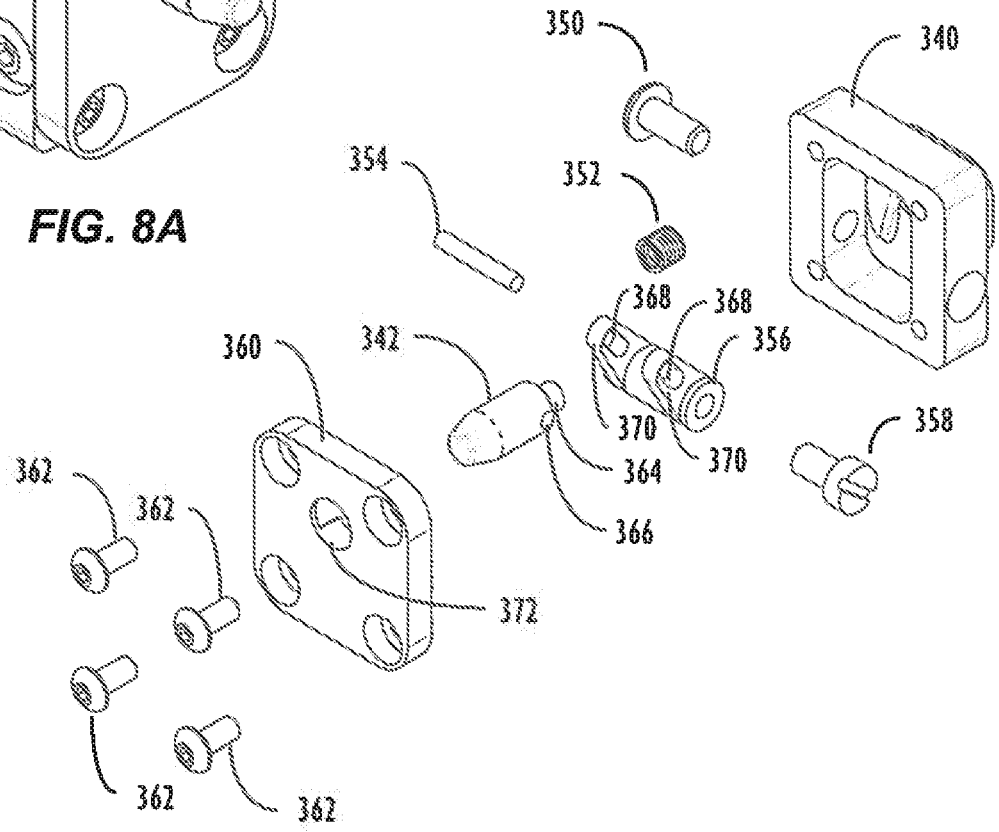
FIG. 8B is an exploded view of the shear pin housing of the embodiment of the anchor tool shown in FIG. 8A.

FIG. 8 illustrates an exploded view of the shear pin housing 340. As shown, the shear pin housing 340 contains a shear pin rocker arm 356. The shear pin 342 is attached to the shear pin rocker arm 356 by means of a rocker arm pin 354 that passes through the hole 366 in the shear pin 342 and the holes 368 in each of the rocker arm brackets 370, such that rotation of the rocker arm 356 causes the shear pin 342 to extend through the hole 372 in the shear pin housing cover 360. The rocker arm 356 can be maintained in its position, within the shear pin housing 340, by screws 350 and 358, which can be disposed in the sides of the housing 340. The spring 352 can be positioned against the back wall of the housing 340 and can receive the post 364 of the shear pin 342, which exerts an axial force on the shear pin 342 towards the cover 360 of the shear pin housing 340, resulting in the rotation of the shear pin rocker arm 356 and the extension of the shear pin 342 through the hole 372 when the hole 372 is not obstructed by the blade 312. As shown, the cover 360 is secured to the shear pin housing 340 by one or more fasteners (e.g., screws) 362; however, other means of securing the cover 360 to the shear pin housing 340 can be used. As described above, the extension of the shear pin 342 into the shear pin receptacle 328 of the blade 312 results in the restriction of the radial motion of the blade 312 relative to the anchor tool body 304.

Figure 9A:
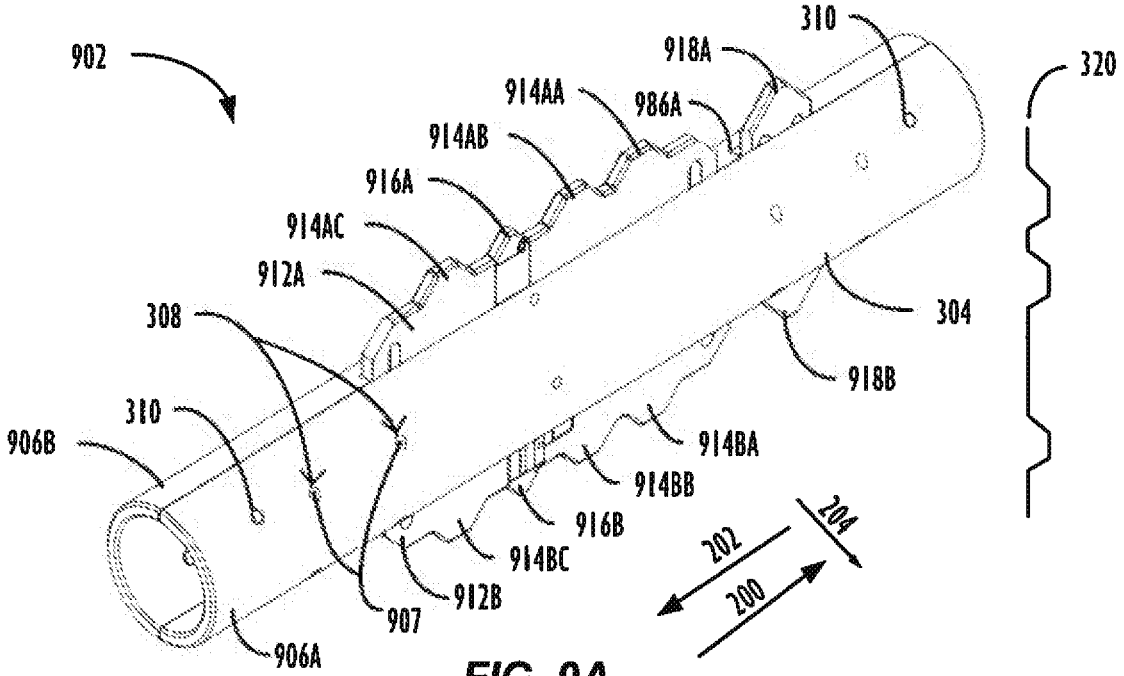
FIGS. 9A and 9B are an isometric view and a side view, respectively, of an anchor tool in a fully extended position in accordance with an embodiment of the disclosure.
Figure 9B:
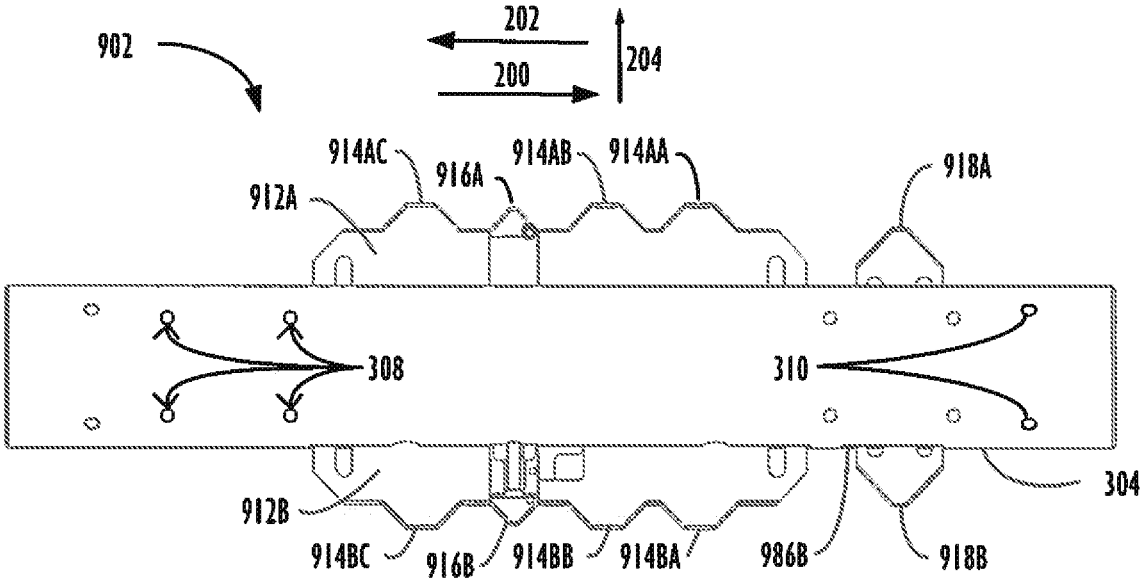

FIGS. 9A and 9B illustrate a potential embodiment of a direction-specific anchor tool 902. A direction-specific tool may only lock in place when traveling in a particular direction 206 and thus, the figures indicate the direction 206 of tool movement (See also FIGS. 10A and 10B) within the conduit 110. The anchor tool 902 is similar in several respects to the anchor tool 302. Like anchor tool 302, the direction-specific anchor tool 902 is constructed from two half cylindrical portions 906A, 906B that can be joined via fasteners 907 disposed in internal connection cavities 308. Likewise, anchor tool 902 includes external connection cavities 310 that allow the anchor tool to be connected to a lowering device and/or a job-specific tool, as described above. Blades 912A, 912B extend radially from opposing sides of the body of the anchor tool 902 and are biased towards the extended position. Each of the blades 912A, 312B includes one or more fixed protrusions 914 (Shown in FIGS. 9A, 9B, 10A, and 10B as 914AA, 914AB, 914AC and 914BA, 914BB, 914BC) that define an anchor tool key 320. That is, in certain embodiments, the anchor tool 902 includes three protrusions 914AA, 914AB, and 914AC located at three positions, respectively. The corresponding anchor sub 102A would have features that match to these three positions.

Unlike the anchor tool 302, the anchor tool 902 additionally includes radial sliding protrusions 916A, 916B that extend outward from the body of the anchor tool 902 and move radially independent of the radial movement of the blades 912A, 912B. The anchor tool 902 further includes axial sliding protrusions 918A, 918B that extend outward from a body 304 of the anchor tool 902 through slots 986A, 986B. The axial sliding protrusions 918A, 918B move both radially and axially relative to the body 304 of the anchor tool 902. It should be noted that neither the radial sliding protrusions 916A, 916B nor the axial sliding protrusions 918A, 918B contribute to the profile of the key 320 formed by the fixed protrusions 914 of the blades 912.

Figure 10A:
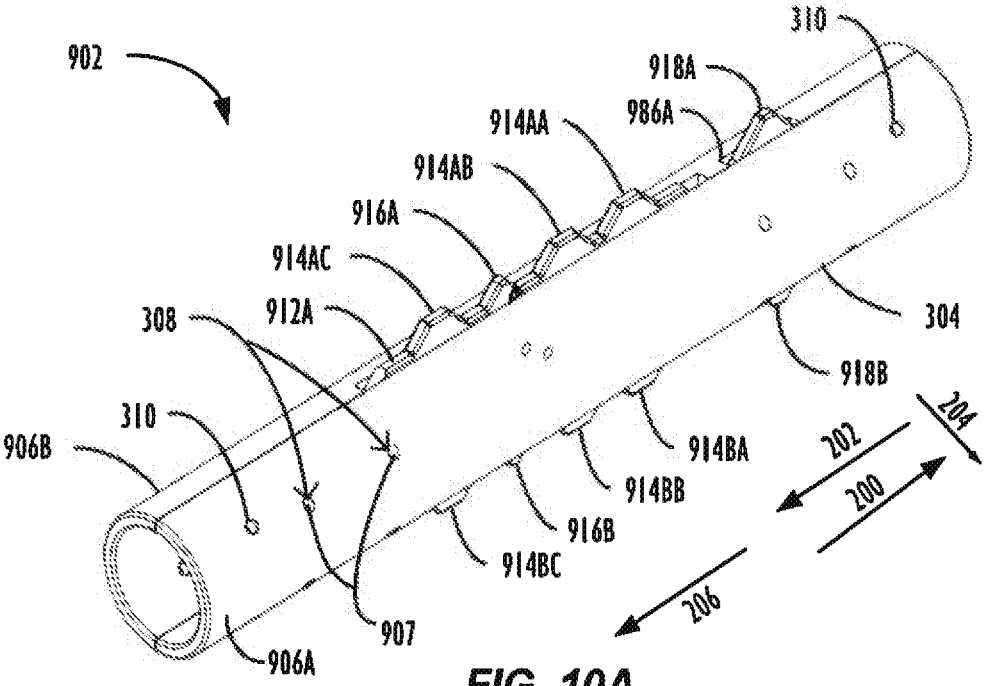
FIGS. 10A and 10B are an isometric view and a side view, respectively, of an anchor tool in a fully retracted position in accordance with an embodiment of the disclosure.
Figure 10B:
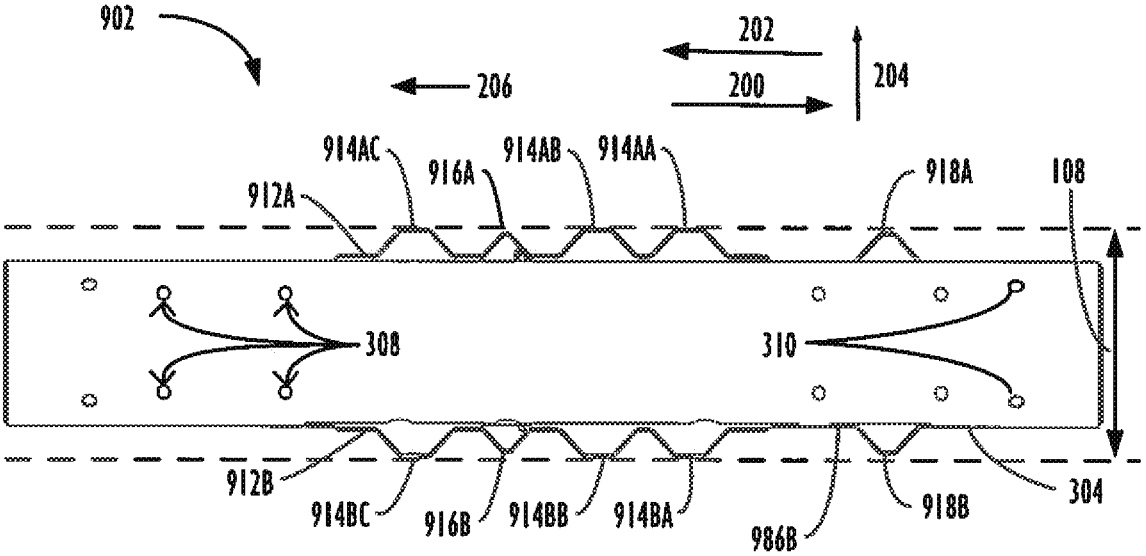

In FIGS. 9A and 9B, the blades 912A, 312B and the sliding protrusions 916A, 316B and 918A, 918B are illustrated in the shelf state. In this state, the blades 912A, 312B, the radial sliding protrusions 916A, 916B, and the axial sliding protrusions 918A, 918B are fully extended in the radial direction 204 (i.e., protruding from the body of the anchor tool to the maximum extent). In addition, the axial sliding protrusions 918A, 918B are internally biased (e.g., via a spring applying a force) toward the uphole 200 position within the slots 986A, 986B. As described above and with respect to the anchor tool 302, this shelf state position is only observed when the anchor tool 902 is located external to a conduit 110. When the anchor tool 902 is lowered into a conduit 110 and is not aligned with a compatible anchor sub 102, the outside edges of the fixed and sliding protrusions 914, 916, and 918 contact the inner wall 108 of the conduit 110, as illustrated in FIGS. 10A and 10B. As will be described below, when the anchor tool 902 is being lowered into the conduit 110, the axial sliding protrusions 918A, 918B maintain their axial position at the uphole end of the slots 986A, 986B, as is illustrated in FIGS. 10A and 10B. In one embodiment, the axial position of the protrusions 918A, 918B is maintained through one or more springs that apply an axial force on the protrusions 918A, 918B in the uphole direction. In another embodiment, the axial position of the protrusions 918A, 918B is maintained by the friction between the outer edge of the protrusions 918A, 918B and the inner wall 108 of the conduit 110 as the anchor tool 902 is lowered into the conduit 110.

Figure 11:
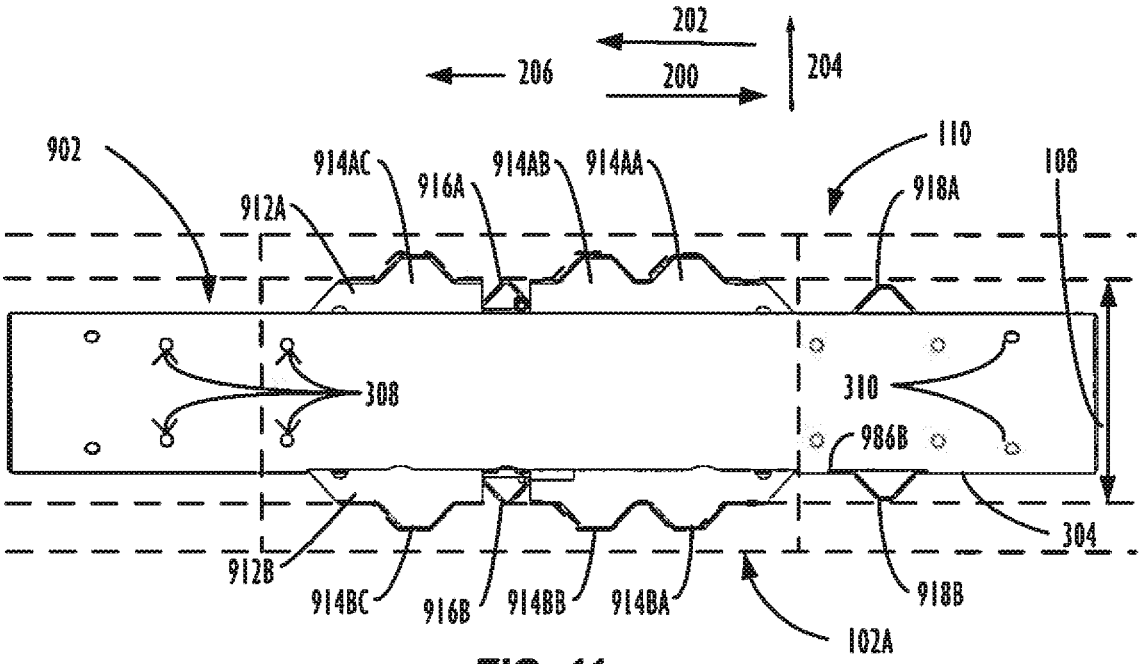
FIG. 11 is a side view of an anchor tool in an unarmed position in accordance with an embodiment of the disclosure.

Referring to FIG. 11, as the anchor tool 902 is lowered into the conduit 110, it is aligned with a compatible anchor sub 102. In this position, the protrusions 914 are aligned with corresponding grooves 106 (e.g., 914AA, 914AB and 914AC are aligned with corresponding grooves 106AA, 106AB and 106AC, respectively, and 914BA, 914BB and 914BC are aligned with corresponding grooves 106BA, 106BB and 106BC, respectively), and the blades 912A, 912B extend outward. Likewise, the radial sliding protrusions 916A, 916B contact the inner wall 108 of the conduit. Although the anchor tool 902 is aligned with a compatible anchor sub 102, the anchor tool 902 is not latched into place because the anchor tool 902 is moving in the downhole direction and the axially sliding protrusions 918A, 918B are situated in the uphole position within the slots 986A, 986B, respectively. Because the blades 912A, 912B move freely in the radial direction relative to the body of the anchor tool 902, the anchor tool 902 passes through the compatible anchor sub 102 and continues moving in the downhole direction. This allows an operator to utilize multiple anchor subs that have a common receptacle 104 within a conduit 110. For example, referring to FIG. 111, although an anchor tool 902 may be configured with blades 912 that make it compatible with anchor sub 102A, the anchor tool 902 may pass through undesired uphole anchor subs 102A and be latched within a desired downhole anchor sub 102A when it is aligned with the anchor sub 102A, while traveling in a traveling direction 206 that is in an uphole direction 200.

Figure 12:
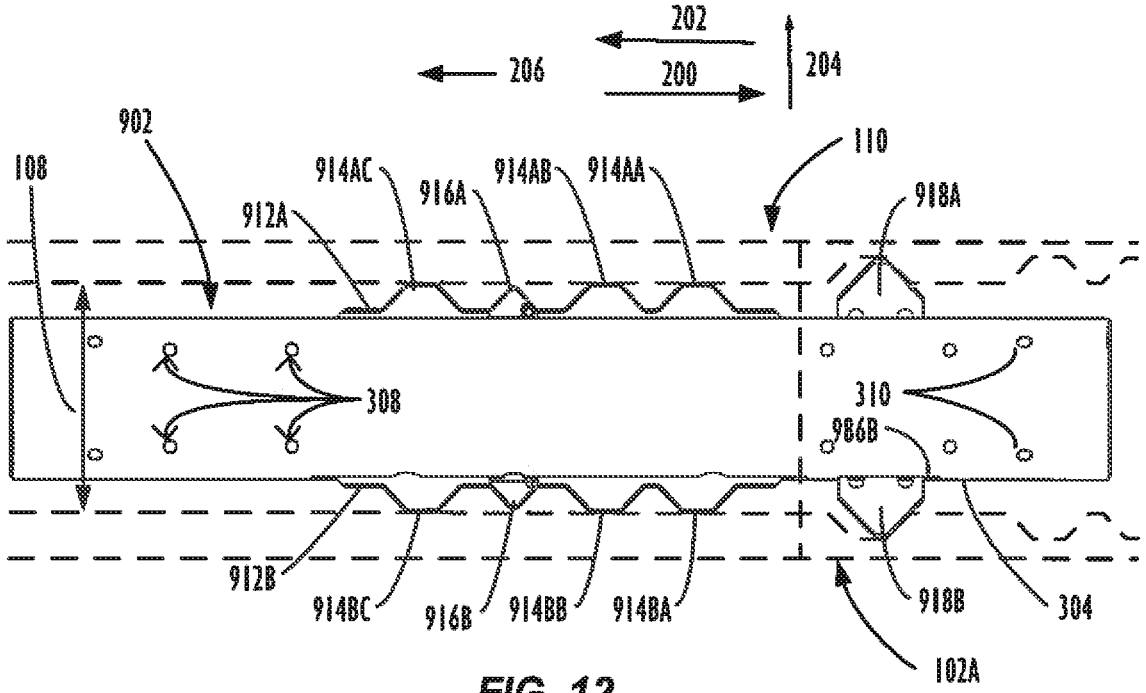
FIG. 12 is a side view of an anchor tool in an armed position in accordance with an embodiment of the disclosure.

When the anchor tool 902 is traveling 206 in an uphole direction 200 as indicated in FIG. 12 and the axial sliding protrusions 918A, 918B contact one or more grooves 106 of an anchor sub 102, the axial sliding protrusions 918A, 918B can expand into the one or more grooves 106. The friction between the shoulders of the protrusions 918A, 918B and the groove(s) 106 can result in the axial movement of the protrusions 918A, 918B to the downhole end of the slots 986A, 986B. This position will be described as the "armed" position, as it results in the axial alignment of the shear pins with the blades' shear pin receptacles and enables the blades to be latched when the anchor tool 902 is aligned with a compatible anchor sub 102. After the anchor tool has transitioned to the armed position, the frictional force between the protrusions 918A, 918B and the inner wall 108 of the conduit 110 will maintain the armed position until the direction of the anchor tool 902 is reversed. While the described embodiment requires the engagement of the protrusions 918A, 918B within a groove(s) 106 to transition to the armed position, in another embodiment, the anchor tool 902 may be armed solely by the friction generated between an axial sliding protrusion 918A, 918B and the inner wall 108 of the conduit 110. In such an embodiment, it may not be necessary for the axial sliding protrusion to move radially relative to the body of the anchor tool 902.

Figure 13A:
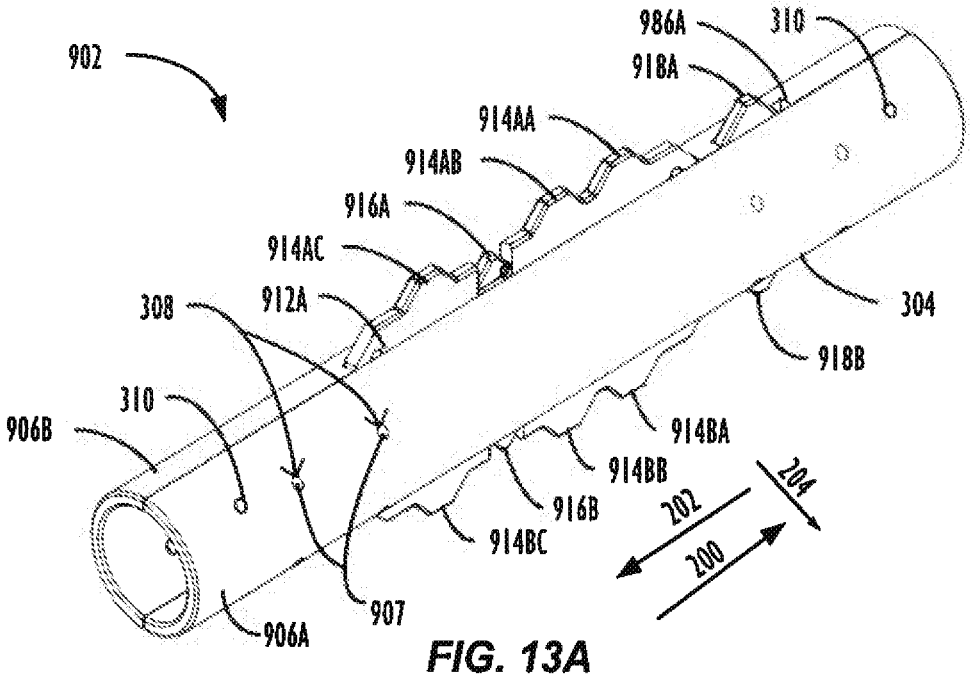
FIGS. 13A and 13B are an isometric view and a side view, respectively, of an anchor tool in a locked position in accordance with an embodiment of the disclosure.
Figure 13B:
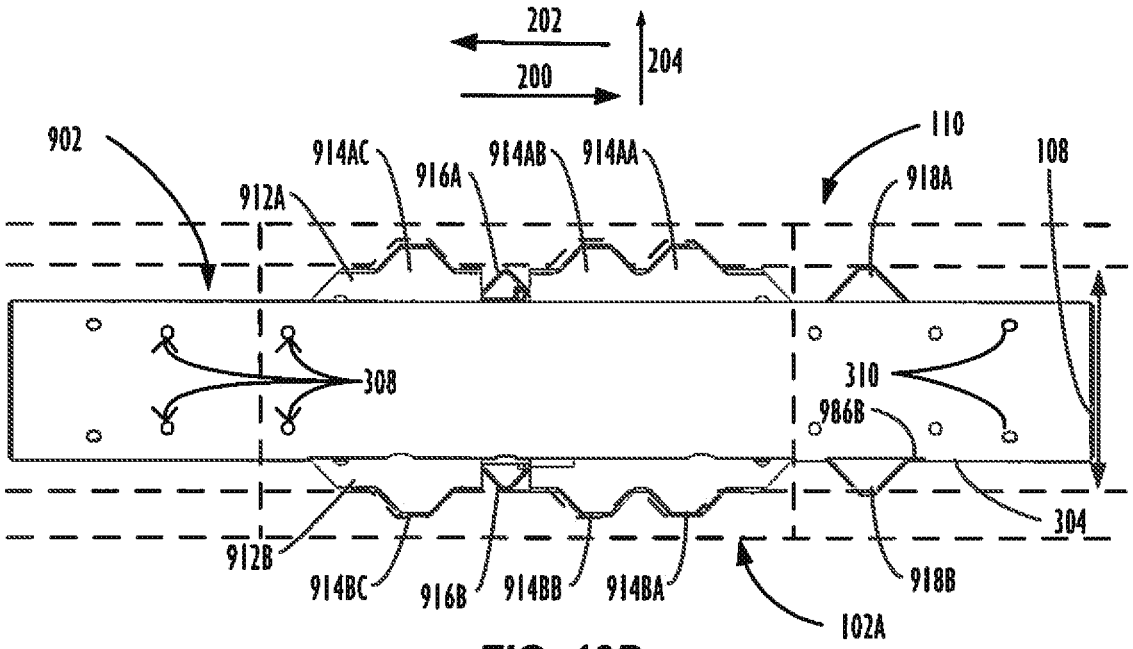

Referring to FIGS. 13A and 13B, when the tool 902 is armed and aligned with a compatible anchor sub 102 (shown in FIG. 13B as anchor sub 102A), the protrusions 914 (shown in FIGS. 13A and 13B as 914AA, 914AB, 914AC and (14BA, 914BB, 914BC) can expand into corresponding grooves of the anchor sub 102. Simultaneously, the radial sliding protrusions 916A, 916B can contact the inner wall 108 of the conduit 110 and retract relative to the blades 912A, 912B. As will be described below, these actions result in the blades 912A, 912B being fixed radially relative to the body of the anchor tool 902. Because the protrusions 914 are situated in corresponding grooves 106 of the anchor sub 102 and because the blades 912 are fixed radially relative to the body of the anchor tool 902, the anchor tool 902 is positioned and maintained at the precise location of the anchor sub 102. It should be noted that the positions of the blades 912 and the radial sliding protrusions 916 are identical whether the tool 902 is traveling 206 in the downhole 202 or uphole 200 directions as illustrated in FIGS. 11 and 13B, respectively. The position of the axial sliding protrusions 918A, 918B, however, prevents the anchor tool 902 from being latched into a compatible anchor sub when the traveling direction 206 is in the downhole direction 202 and enables it to be latched into a compatible anchor sub when the traveling direction 206 is in the uphole direction 200.

Figure 14:
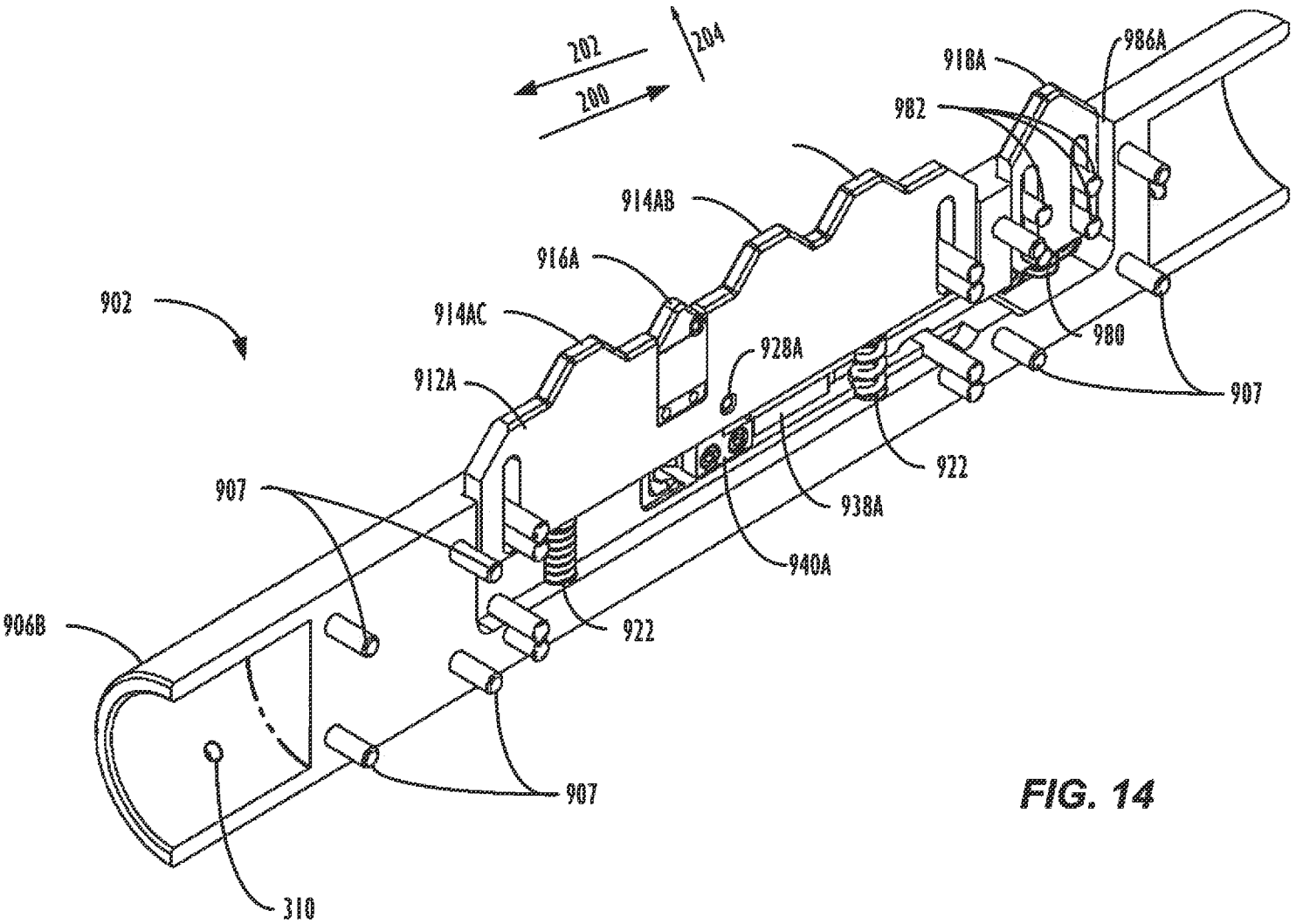
FIG. 14 is a cutaway isometric view showing the internals of an anchor tool in accordance with an embodiment of the disclosure.

FIG. 14 illustrates an embodiment of the tool 902 of FIG. 9 having the half cylindrical portion 906A and blade 912B removed to provide a view of the internal structures. It will be understood that the removed items function in the same manner as the corresponding illustrated items. Blade 912A is biased towards its fully extended position by springs 922. Radial sliding protrusion 916A may move independently from the blade 912A and is shown biased towards its fully extended position (by a spring that is hidden in the illustration in FIG. 14). Likewise, axial sliding protrusion 918A may move independently from the blade 912A and can be biased in the radial direction towards its fully extended position by a spring 980, and biased in the uphole 200 (i.e., unarmed) direction within slot 986A. The axial sliding protrusion 918A is linked to a carriage 938A. The axial movement of the axial sliding protrusion 918A results in the axial movement of the carriage 938A, which, in turn, results in the movement of the shear pin housing 940A to align a shear pin within the housing with the shear pin receptacle 928A. As shown, the alignment of the axial sliding protrusion 918A is maintained by the use of guide pins 982 moving within slotted areas.

Like anchor tool 302, anchor tool 902 requires both radial and axial motions to cause the alignment of a shear pin 942 (See FIG. 15A) with a shear pin receptacle 928A disposed in the blade 912. In FIGS. 15A through 15D, a shear pin housing 940 is located behind a shear pin cover 990 that is attached to and moves with the radial sliding protrusion 916. Both the shear pin housing 940 and the shear pin cover 990 are located behind the blade 912. In one embodiment, the shear pin housing 940 may be constructed in a similar manner to shear pin housing 340 such that the shear pin 942 is biased towards the blade 912.

Figure 15A:
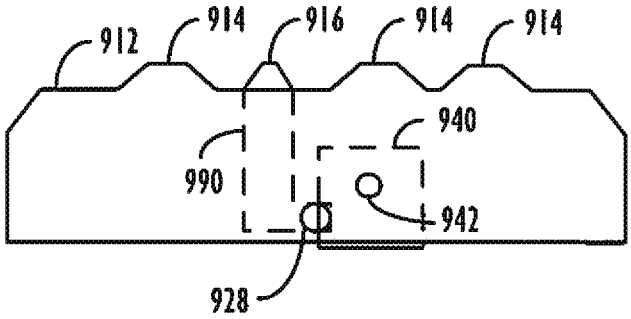
FIGS. 15A through 15D are schematic diagrams of the internals of an anchor tool in various states of operation in accordance with an embodiment of the disclosure.
Figure 15B:
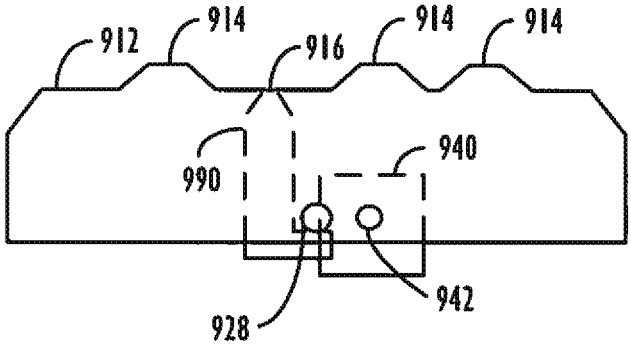
Figure 15C:
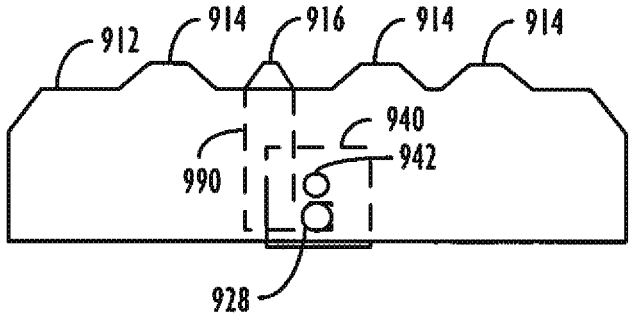
Figure 15D:
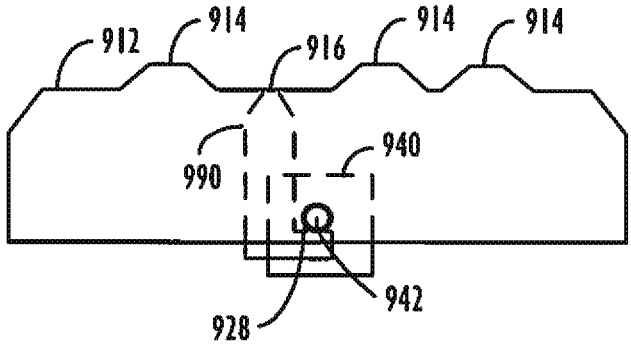

FIG. 15A illustrates an embodiment of possible relative positions of the internal components of the anchor tool 902 in the unarmed and retracted state (i.e., the state illustrated in FIGS. 10A and 10B). In this position, the shear pin 942 is misaligned with the shear pin receptacle 928 in both the axial and radial directions. FIG. 15 shows the shear pin cover 990 for the shear pin 942, and includes the blade 912 of the anchor tool 902, with fixed protrusions 914 and radial sliding protrusions 916. FIG. 15B illustrates the relative positions of the internal components when the anchor tool 902 is aligned with a compatible anchor sub and traveling 206 in the downhole direction (i.e., in the unarmed position illustrated in FIG. 11). In this position, the protrusions 914 extend into the corresponding grooves 106 of the compatible anchor sub 102 and the radial sliding protrusion retracts relative to the blade 912, which moves the shear pin cover 990 and exposes the shear pin 942. However, because the anchor tool is in the unarmed position, the shear pin 942 and the shear pin receptacle 928 are misaligned in the axial direction and the blade 912 is not latched. FIG. 15C illustrates the relative positions of the internal components of the anchor tool 902 in the armed and retracted state (i.e., the state illustrated in FIG. 12). In this position, the axial position of the axial sliding protrusion 918 (not shown) has armed the anchor tool 902 by moving the shear pin housing 940 such that the shear pin 942 and the shear pin receptacle 928 are in axial alignment. Because the tool is not aligned with a compatible anchor sub, however, there is no radial alignment of the shear pin 942 and shear pin receptacle 928. FIG. 15D illustrates the relative positions of the internal components when the anchor tool 902 is latched in a compatible anchor sub. In this position, the anchor tool 902 is armed as it travels in the uphole direction, and the protrusions 914 are extended into corresponding grooves 106 of a compatible anchor sub 102. In addition, the radial sliding protrusion is retracted relative to the blade 912 such that the shear pin cover 990 does not interfere with the engagement of the shear pin 942 into the shear pin receptacle 928. Like the anchor tool 302, the latched position is maintained until a force great enough to overcome the holding force of the shear pin 942 is applied to the anchor tool 902. As such, the anchor tool 902 can traverse compatible anchor subs when traveling 206 in the downhole direction and be latched into compatible anchor subs when traveling 206 in the uphole direction, such that an attached job-specific tool can be located and maintained at a position relative to one of multiple compatible anchor subs in a wellbore conduit.

The anchor tools and anchor subs described herein can be provided in a variety of diameters to accommodate a variety of tasks. Typical anchor tool outside diameters range from about 19.05 mm (0.75 inches) to about 15.24 cm (6 inches), or greater. Moreover, while the described anchor tools include two blades positioned 180 degrees apart, other embodiments might include more or fewer blades positioned around the body of the anchor tool. The construction of the described anchor tool allows the blades to be efficiently changed onsite to correspond to a desired anchor sub.

While various embodiments of the present invention have been described with emphasis, it should be understood that within the scope of the appended claims, the present invention might be practiced other than as specifically described herein.

What is claimed is:

1. An anchor tool for positioning downhole, comprising:

a body configured to be disposed within a conduit in a wellbore;

one or more blades configured to move radially relative to the body, wherein at least one of the one or more blades comprises a shear pin receptacle and a key having a fixed protrusion configured to match a corresponding groove of an anchor sub receptacle within the conduit;

a pivoting protrusion connected to each of the one or more blades and coupled to a movable carriage comprising a shear pin; and a locking mechanism comprising a first state and a second state, wherein the first state permits radial movement of the one or more blades relative to the body of the anchor tool and the second state inhibits radial movement of the one or more blades relative to the body of the anchor tool via rotation of the pivoting protrusion that moves the carriage to a position in which the shear pin is inserted into the shear pin receptacle, and wherein the locking mechanism is configured to switch to the second state from the first state as soon as the fixed protrusion extends into the corresponding groove of the anchor sub receptacle.

2. The anchor tool of claim 1, comprising a first end configured to connect a job-specific tool to the body.

3. The anchor tool of claim 1, wherein the body comprises two half cylindrical portions configured to disassemble for replacement of the one or more blades, replacement of a shear pin, or combinations thereof.

4. The anchor tool of claim 1, comprising a spring configured to bias the one or more blades toward an extended radial position relative to the body.

5. The anchor tool of claim 1, wherein rotation of the pivoting protrusion to a fully retracted position transitions the locking mechanism to the second state.

6. The anchor tool of claim 1, wherein another blade is positioned opposite each of the one or more blades, and is configured to match with and lock into a corresponding anchor sub receptacle when the locking mechanism transitions to the second state.

7. The anchor tool of claim 1, wherein the locking mechanism comprises one or more shear pin housings, wherein each of the one or more shear pin housings are configured to contain additional shear pins.

8. The anchor tool of claim 7, wherein alignment of the one or more shear pins and the one or more shear pin receptacles requires a correct radial positioning of the one or more blades relative to the body and a correct axial positioning of the one or more shear pin housings relative to the one or more blades.

9. The anchor tool of claim 8, wherein axial positioning of the one or more shear pin housings is accomplished via a rotation of one or more pivoting members attached to the one or more blades.

10. The anchor tool of claim 1, wherein the locking mechanism is configured to activate only when the anchor tool is traveling in an uphole direction within the conduit.

11. A method of positioning a downhole tool, comprising:

positioning an anchor sub along a conduit in a wellbore, wherein the anchor sub comprises one or more grooves that define an anchor sub receptacle;

connecting the downhole tool to an anchor tool, wherein the anchor tool comprises:

a body configured to be disposed within the conduit;

one or more blades configured to move radially relative to the body, wherein the at least one of the one or more blades comprises a shear pin receptacle and a key having a fixed protrusion configured to match the one or more grooves of the anchor sub receptacle;

a pivoting protrusion connected to each of the one or more blades and coupled to a movable carriage comprising a shear pin; and a locking mechanism comprising a first state and a second state, wherein the first state permits radial movement of the blade relative to the body and the second state inhibits radial movement of the one or more blades relative to the body via rotation of the pivoting protrusion that moves the carriage to a position in which the shear pin is inserted into the shear pin receptacle;

lowering the downhole tool into the tubular string until the anchor tool and the anchor sub receptacle are aligned; and locking the locking mechanism into the second state as soon as the fixed protrusion extends into the one or more grooves of the anchor sub receptacle.

12. The method of claim 11, wherein connecting the downhole tool to the anchor tool comprises connecting a rigid connecting device between the downhole tool and the anchor tool.

13. The method of claim 12, wherein a length of the rigid connecting device corresponds to a known distance between a location of the anchor sub receptacle and a location of an intended downhole operation using the downhole tool.

14. The method of claim 11, wherein the downhole tool is positioned above the anchor tool when the downhole tool is lowered into the tubular string.

15. The method of claim 11, further comprising lowering the downhole tool passed a non-matching anchor sub receptacle before the anchor tool and the anchor sub receptacle are aligned.

* * * * *